United States Patent [19]

Tsujimura

[11] 4,267,901

[45] May 19, 1981

[54] DUAL TYPE FREE-WHEEL/DRIVE-ON VEHICLE LIFT

[75] Inventor: Tozaburo Tsujimura, Fujinomiya, Japan

[73] Assignee: Yasui Sangyo Co., Ltd., Fujinomiya, Japan

[21] Appl. No.: 18,071

[22] Filed: Mar. 8, 1979

[30] Foreign Application Priority Data

Oct. 4, 1978 [JP] Japan ..... 53-122348

[51] Int. Cl.[3] ..... B66F 7/00

[52] U.S. Cl. ..... 187/8.54; 187/8.67

[58] Field of Search ..... 187/8.54, 8.45, 8.41, 187/8.49, 8.74, 8.75, 8.67

[56] References Cited

U.S. PATENT DOCUMENTS

Re. 26,232 6/1967 Lill ..... 187/8.67

2,552,974 5/1951 Johnson ..... 187/8.54

FOREIGN PATENT DOCUMENTS 1225362 9/1966 Fed. Rep. of Germany ..... 187/8.54

*Primary Examiner*—Charles A. Marmor

*Assistant Examiner*—Kenneth Noland

*Attorney, Agent, or Firm*—Michael A. Painter

[57] ABSTRACT

A vehicle lift which can be used as either a drive-on type lift or a free-wheel lift in which the vehicle is suspended by its underbody. An underbody support is provided which has foldable legs extending down from it which project through holes in the lift vehicle support ramps. When the lift is being used as a drive-on lift, these legs are folded away, and when the lift is to be used as a free-wheel type, these legs are opened out and hang vertically, in which position the vehicle may be lifted off the vehicle support ramps by lowering them, thus pushing the underbody support upwards via the legs away from the support ramps and lifting the vehicle thereby.

5 Claims, 4 Drawing Figures

DUAL TYPE FREE-WHEEL/DRIVE-ON VEHICLE LIFT

This invention relates to a vehicle support ramp for a vehicle, which is mounted to a carriage and moves up and down on a support pillar.

For convenience when inspecting or repairing the underside of a vehicle, or when cleaning and painting it, and so forth, two-pillar lifts are widely used, in which each of the two support pillars supports a carriage which moves up and down on it, and wherein from each carriage extends inwards, for example, two support arms, in a fork-like configuration, forming a vehicle support means. The free ends of these arms are inserted under the sides of the vehicle, and then as the two carriages are raised the vehicle is lifted to the desired height.

Various other lifting devices of this sort are known. They have in common the characteristic of being of the free-wheel type; that is, they support the vehicle by its body or its chassis, and the wheels of the vehicle are left free to turn with no weight being supported by them. Further, generally the suspension parts of the vehicle are also left to hang free; in other words, the parts of the lifting device that support the vehicle are inserted, generally, under fixed parts of the chassis or the body, and only exceptionally are inserted under parts of the suspension that move relative to the body of the vehicle.

Therefore, such a method of support is very convenient when one has to work on the wheels or wheel bearings of the vehicle, or when suspension or shock absorber work is called for, since no load is imposed upon these parts, and therefore they may be disassembled at will. Further, in general such a supporting system is convenient for general work on the underneath of a vehicle, because little room is taken up by the supporting means. However, circumstances arise when it is desirable to have the vehicle supported by the wheels while it is elevated. For instance, it is quite impossible to perform the operation of checking wheel alignment while the weight of the vehicle is not supported by the wheels, since variations in the load imposed on the front suspension affect the wheel alignment adjustment. Further, in the case of vehicles which have adjustable suspension, obviously the checking of vehicle riding height cannot be made unless the entire weight of the vehicle is supported on its wheels in the usual manner. Further, of course checks as to problems of the body fouling the steering or suspension, or the like, again require that the vehicle be elevated while its weight is supported on its wheels. Also, if the underside of the vehicle is to be completely coated with some substance, such as in the case of underbody anti-rust treatment or undersealing, it is obviously not acceptable for any part of the underbody or chassis to be covered by such vehicle support means as detailed above, and therefore, again, it is necessary to support the vehicle, in the elevated state, by its wheels.

Therefore, in such cases it is much more convenient to use a drive-on type vehicle lift, in which the vehicle is driven on to a pair of support ramps, which are then moved up and down two pillars together and thereby lift the vehicle by its wheels. Therefore, heretofore, for most efficient operation of a vehicle repair facility, it has usually been necessary to provide two different vehicle lifts, one being of the underbody-support or free-wheel type, and the other being of the drive-on type. However, this duplication is obviously expensive and inefficient, and in the case of smaller repair shops can be prohibitively costly.

Even if two such vehicle lifts of different types are provided, problems can arise. Consider the operation of adjusting the riding height of a vehicle of the type wherein the suspension is adjusted by shimming the springs, and wherein the height of the body is to be measured by checking the distances from various suspension parts to the body. In this case, for shimming the springs it is required that the vehicle be supported by its chassis or body so that no force is put on the suspension and it is allowed to hang freely, while checking the riding height involves access to the underside of the vehicle while it is supported by its wheels in the same way as when it is in use on the road. Since the adjustment is a repetitive process, converging to the correct adjustment, repeated changing of the vehicle from one lift to the other is required. This is inefficient.

Therefore, it is an object of the present invention to provide a vehicle lift in which the aforementioned disadvantages are overcome, and which combines the features of both a free-wheel type and a drive-on type lift, and which can be used for supporting a vehicle by either its underbody or by its wheels, alternatively.

It is a further object of the present invention to provided such a lift in which the change from the mode of supporting the vehicle by its wheels, to the mode of supporting it by its underbody, and vice-versa, can be made quickly and easily.

It is a further object of the present invention to provide such a vehicle lift which attains its object by a simple, reliable, and cheap mechanism, and which requires no extra active components such as hydraulic cylinders, motors, or the like for the changing of the mode of support of the vehicle, but which uses only passive components such as metal bars and hinges to attain its beneficial results.

According to the present invention, these and other objects are attained by a vehicle lift, comprising a support pillar, a carriage which moves up and down the support pillar, a support ramp, adapted to support a vehicle by its tires, attached to the carriage, and an underbody support, comprising an underbody contact member and a plurality of supporting legs pivoted to the underside of the underbody contact member which extend through holes in the support ramp in such a manner that when extended they project vertically downward and when folded they are substantially horizontal.

Other objects, features, and advantages of the present invention will become more clear from the detailed description given hereinbelow and the accompanying drawings, which, however, are given for purposes of illustration only, and are not intended to be limitative of the present invention, whose scope is intended to be defined only by the appended claims. The description and the drawings refer only to a preferred embodiment of the present invention, and other embodiments are of course possible within the limits of the claims, and are intended also to be covered thereby. In the drawings:

Figure 1:
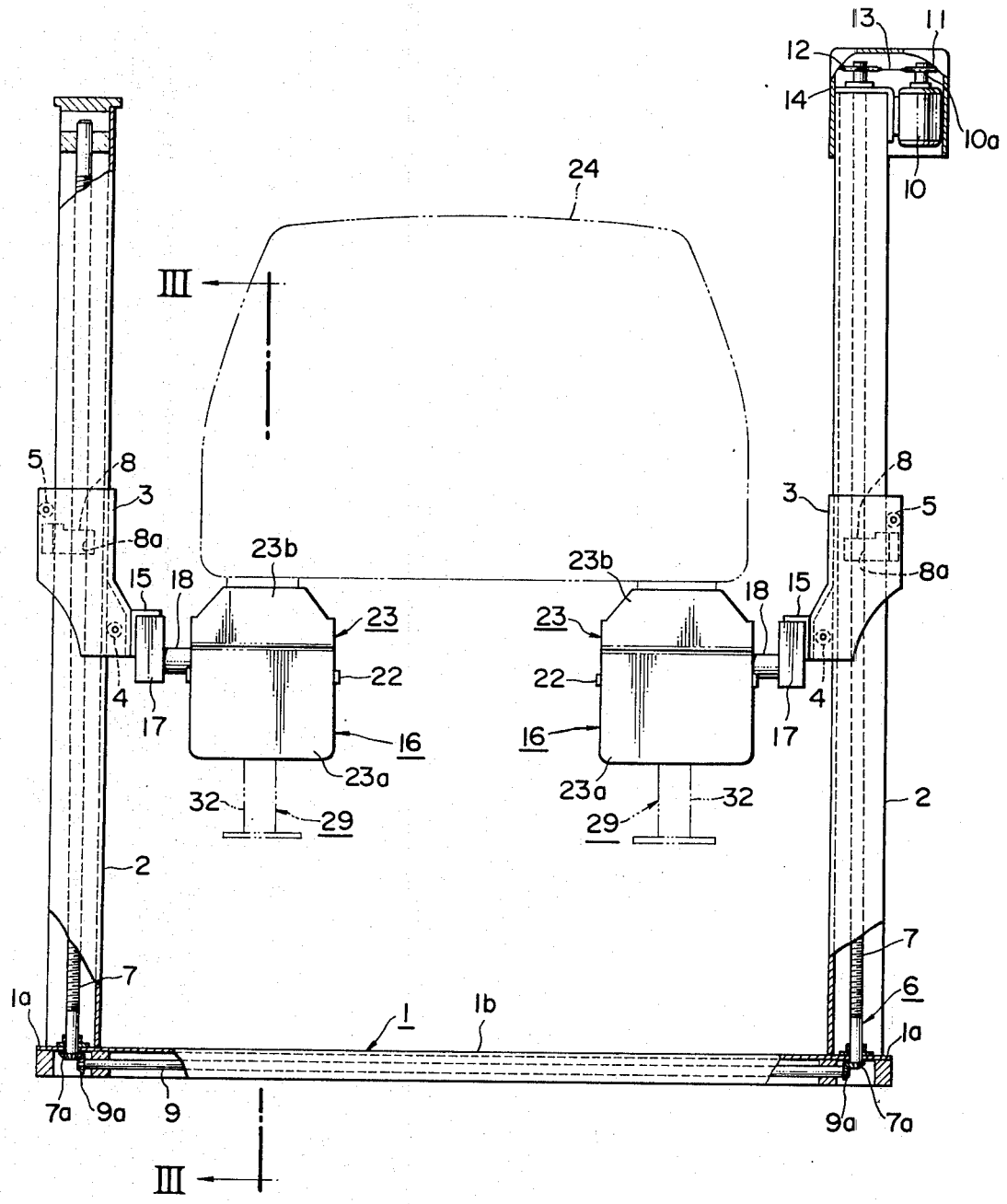
FIG. 1 is a front view, partly cut away, of a vehicle lift according to the present invention, on which a vehicle is being supported in the drive-on mode.
Figure 2:
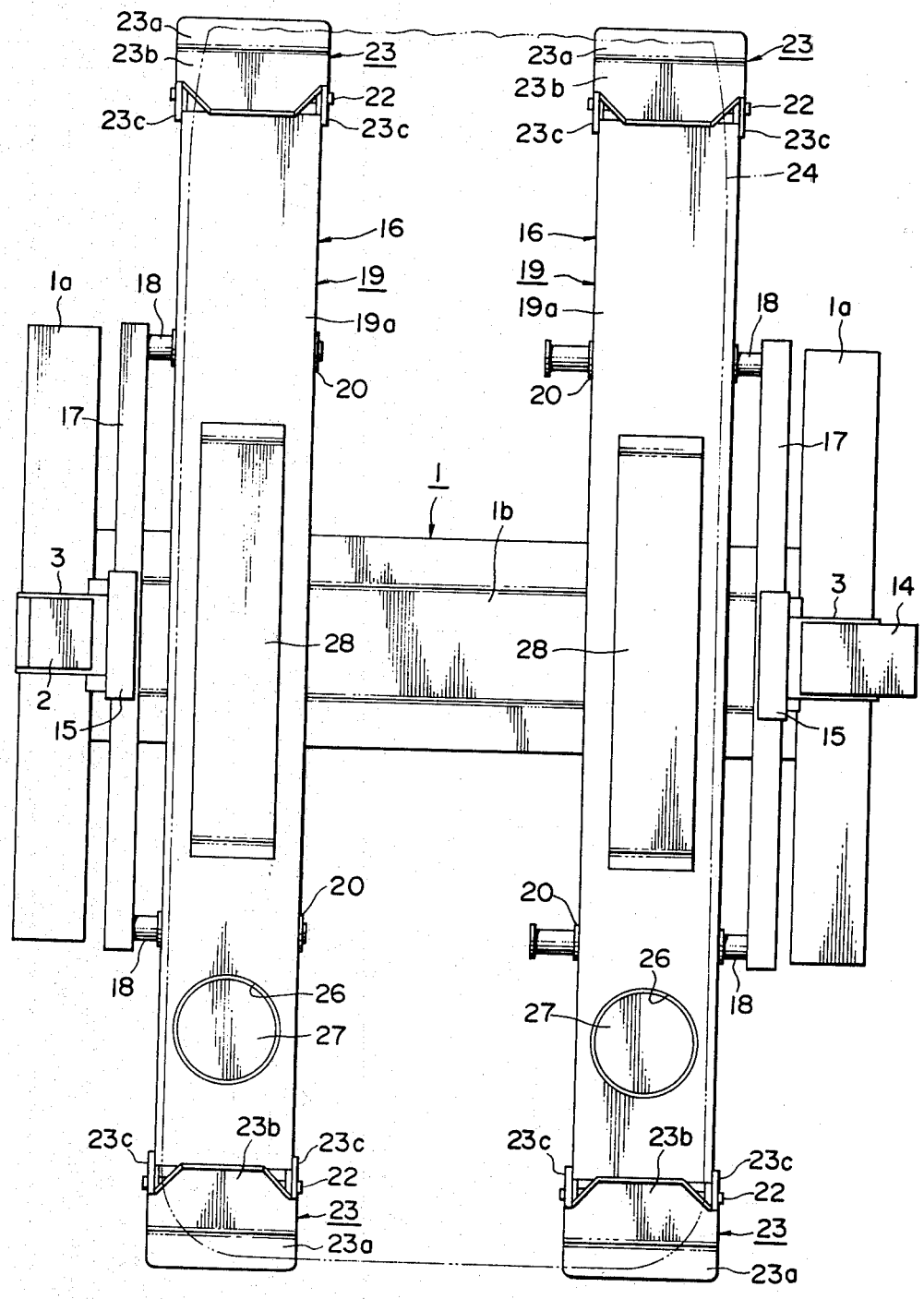
FIG. 2 is a plan view of FIG. 1.
Figure 3:
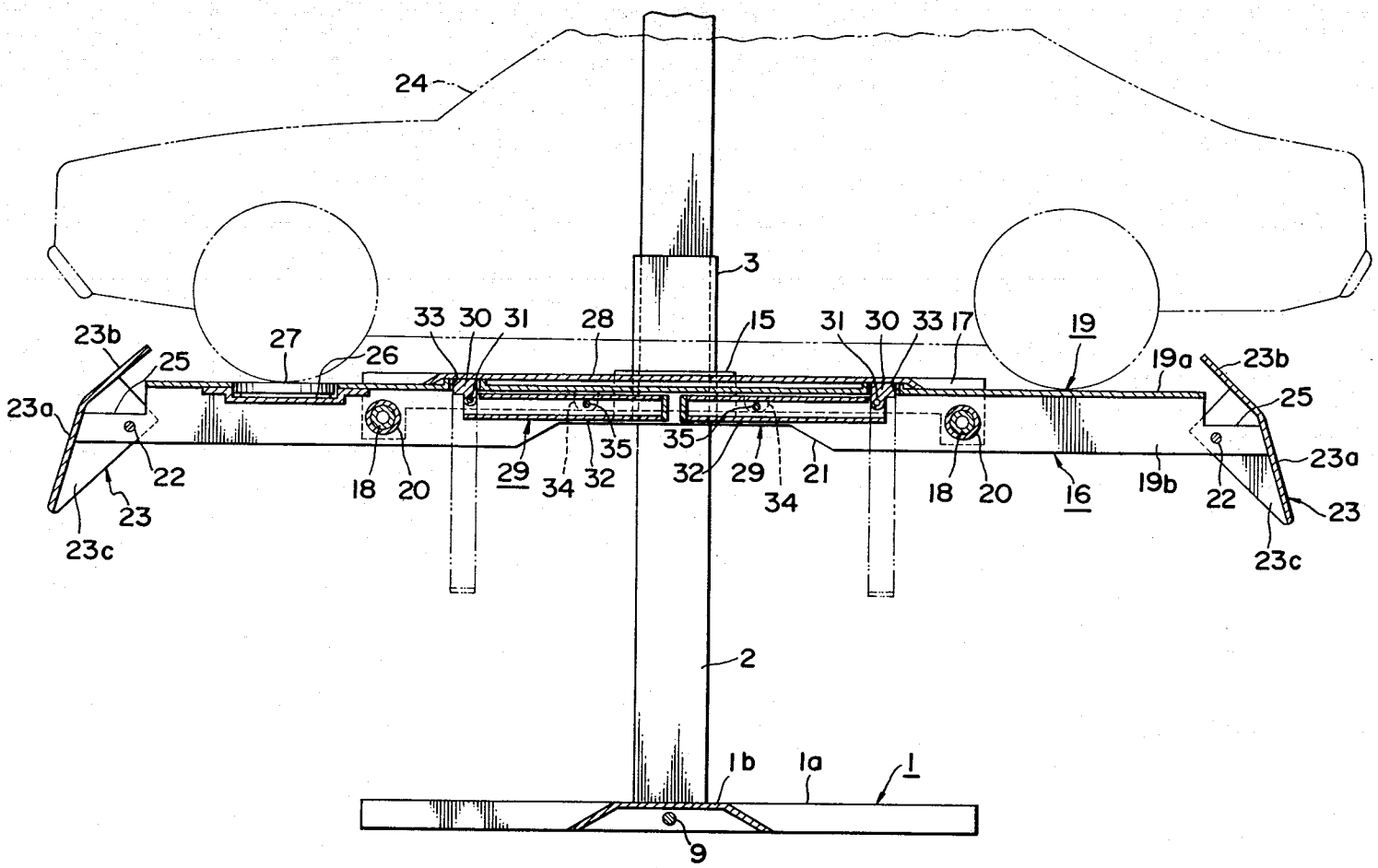
FIG. 3 is a longitudinal sectional view, taken along the line III—III in FIG. 1.

Referring to FIGS. 1–3, there is shown a two-pillar vehicle lift according to the present invention.

An H-shaped base 1 comprising a pair of leg members 1*a* and a coupling member 1*b* therebetween is provided with a pair of support pillars 2 having a U-shaped cross section, each of which stands in the center of one of the leg members 1*a*. On each support pillar 2 is slidably disposed a carriage 3, and each carriage is provided with a pair of rollers 4 and 5 which contact with the inner and the outer surface of the support pillar 2, as shown in FIG. 1, so as to allow the carriage to slide smoothly up and down the pillar. The carriages 3 are moved up and down the pillars 2 by a drive mechanism 6 comprising screw shafts 7 extending in the pillars 2, nut members 8 fixed to the carriages 3, a coupling shaft 9 which connects the screw shafts 7, a reversible motor 10, and so forth.

The two screw shafts 7 are constrained to rotate together by the bevel gears 9*a* and 7*a* and the coupling shaft 9, which connect them, and the whole is turned by the reversible motor 10 via the sprockets 11 and 12 and the chain 13. The turning of the screw shafts 7 screws the nuts 8 up or down them, and thereby the two carriages 3 are moved up or down their pillars 2 together.

A bracket 15 is attached to the lower inner side of each carriage 3. A support bar 17 of a vehicle support 16 is connected to the bracket 15 in its central portion by vertical pins which are not shown which pass through these members. A pair of support arms 18 project inwards from the end portions of the support bar 17. These support arms 18 pass through pipe members 20, which are mounted between the side plates 19*b* of the support ramps 19, which also comprise each an upper plate 19*a* which joins the two side plates 19*b*.

Figure 4:
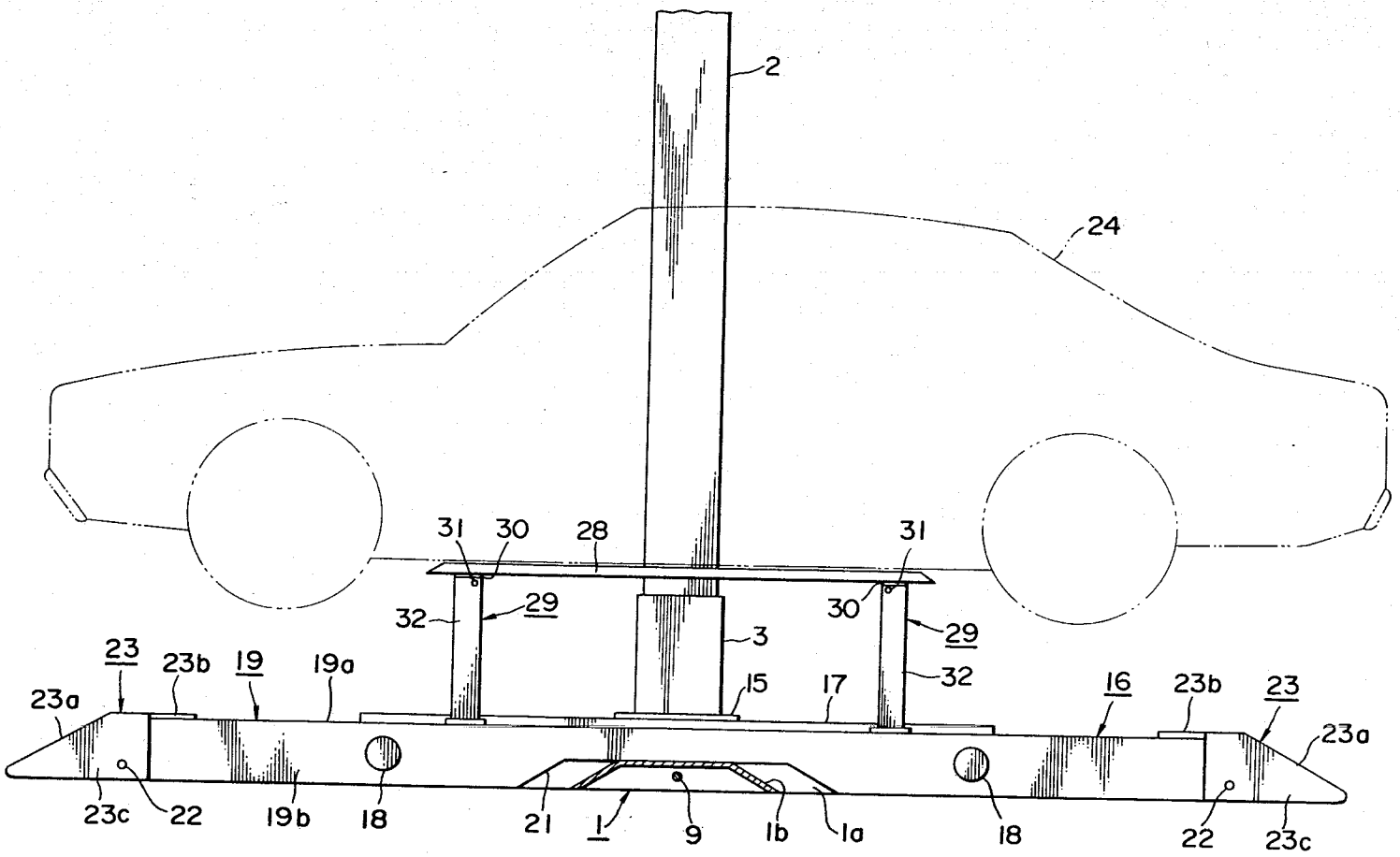
FIG. 4 is a side view, from the same direction as FIG. 3, showing the vehicle lift of FIGS. 1–3 on which a vehicle is being supported in the free-wheel mode.

Each of these support ramps 19 is adapted to support a vehicle by its tyres, when the vehicle is driven onto the upper plates 19*a*. The right hand support arms 18 in the illustrated embodiment are somewhat longer than the left ones, so that the distance between the two support ramps 19 may be adjusted so as to be appropriate for various different vehicles, by sliding the pipe members 20 on the support arms 18. As shown in FIGS. 3 and 4, a cutaway is formed in the side plates 19*b* at their central lower portion, so that the support ramps 19 may be lowered to the very bottom position where they contact the ground, without them fouling the coupling member 1*b* of the base 1.

A pair of ramp members 23 are pivotably mounted to the ends of the vehicle ramps 19 by horizontal shafts 22, each ramp member 23 comprising a sloped ramp portion 23*a* at its end, a top portion 23*b* which is connected to the sloped ramp portion 23*a* and which contacts the upper plate 19*a*, and a pair of side portions 23*c*. As may be seen in FIG. 4, when the vehicle support ramps 19 are in their lowest position, these ramp members 23 pivot so that they act as sloping ramps which allow the vehicle, designated by 24, to be driven onto the vehicle support ramps 19. However, as may be seen in FIG. 3, when the vehicle support ramps 19 are raised, these ramp members pivot, so as to act as safety tyre stops, and so as to positively prevent the vehicle from coming off the vehicle ramps 19. Stops 25 are provided to limit this pivoting.

In the front portion of the upper plates 19*a* are provided circular grooves 26, in which a gauge 27 for measuring the wheel alignment of the vehicle may be arranged.

The arrangements so far described are the ones for use of the vehicle lift as a drive-on type lift, and it will be readily apparent that the lift can so be used. However, as a particular feature of the present invention, an arrangement is provided for also using this lift as a free-wheel type lift, which is easily stowed away when the lift is being used as a drive-on lift and when it is therefore not required, and which can quickly and easily be deployed when needed so as to lift the vehicle up by its underbody or chassis so as to leave the wheels and the suspension hanging freely, as described above.

Over the middle of each upper plate 19*a* is arranged an underbody contact member 28, whose length and exact configuration depends on the distance between the wheels of the sort of vehicle intended to be lifted. A pair of supporting legs 29 are pivotally mounted to the underside of this underbody contact member 28 by pivot shafts 31. Each of these folding support legs 29 comprises a top head 30 and a leg 32 which is pivoted to this top head 30. The legs 29 project downwards from the underbody contact member 28 through holes 33 in the upper plate 19*a*, which, as may be seen in FIG. 3, are actually formed as short pipe members. The arrangement is best seen in FIG. 3. It is seen that, when the underbody contact members 29 are in their lowermost positions, it is possible to fold the legs 32 inwards to the horizontal position, as shown by solid lines in the figure. In this position, these legs may be held by pins 35 which pass through holes in the legs and through holes in the stop members 34 which project downwards from the upper plate 19*a*. In this position, the underbody contact member is stowed away, and does not interfere with the use of this vehicle lift as a drive-on type lift, because it is quite thin, and, as may be seen in FIG. 3, its ends where its top contacts the top of the upper plate 19*a* are formed as slight ramps, so that the vehicle may be conveniently driven up them.

The use of this lift in the drive-on mode is conventional, and need not be described in detail. However, when it is desired to use this lift as a free-wheel type, the construction described above is deployed. First the vehicle is driven onto the lift, while it is being used as a drive-on lift, and the lift is raised, as shown in FIG. 3. Then, the pins 35 are removed, and the legs 32 are pivoted downwards, as shown by the dotted lines in FIG. 3, till they are substantially vertical. Then the lift is lowered. As may be readily imagined, the ends of the legs 32 are the first object that touches the ground. As the carriages 3 continue to be lowered, the underbody supports 28 are lowered no further, because they are supported by the legs 32, which commence to slide through the holes 33. The underbody supports 28 therefore rise with respect to the support ramps 19 until they contact the underbody or chassis of the vehicle. As the carriages continue to be lowered. The vehicle is held stationary by the underbody supports 28, while the support ramps 19 drop away from the wheels and no longer support the wheels or the suspension. Thus the vehicle is held only by the underbody supports 28, which are resting on the ground via the legs 32. Eventually, as seen in FIG. 4, the support ramps 19 touch the ground, and the vehicle is left supported in the air. In this position, the vehicle may be worked on, and the wheels and suspension may be disassembled, as explained above. When it is desired again to use the lift as a drive-on type, or when it is desired to remove the vehicle from the lift, the carriages are again raised, and the wheels of the vehicle will again contact the support ramps 19, the legs 32 having slid through the holes 33, in the reverse manner to that described above. The legs 32 may then be pivoted sideways and stowed away by the pins 35, again.

When the vehicle is being held in the position of FIG. 4, there might be thought that there was a danger of instability, because the parallelogram composed of the two legs 32, the underbody support 28, and the support ramp 19 might be deformed, thereby resulting in an accident. However, this is positively prevented by the fact that the holes 33 conform closely to the external shape of the legs 32, so that only sliding movement of the legs 32 with respect to the support ramps 19 is possible, when the underbody supports 28 are raised, and not angular pivoting. This is aided by the fact that, as mentioned above, the holes 33 are in fact formed by short tubular members. In this respect, it is to be noted that the space between the edges of the holes 33 and the legs 32 in FIG. 3 is somewhat exaggerated for the purposes of clarity. In actual fact, the holes conform much more closely to the shape of the legs 32 than is shown in FIG. 3.

As a further and very useful modification to this invention, means may be provided for fixing the relative positions of the supporting legs 32 to the support ramps 19, when the system is in the position shown in FIG. 4. Such means might conveniently comprise pins passed through the supporting legs 32 and through the side plates **19*b*. If such pins were inserted, when the system was in the position shown in FIG. 4, when the carriages 3 were raised, the vehicle would be raised, without descending to the position shown in FIG. 3, but still held by the underbody supports 28**, as may be easily imagined. This could be very useful for the purposes of working on the suspension of the vehicle, and, although it is not specifically shown in the drawings, must be understood as a particular possibility with respect to the present invention.

Although the invention has been shown and described with respect to a particular embodiment thereof, it should be understood by whom it may concern that various changes and modifications to the form and the content of any particular embodiment may be made therein without departing from the scope of the invention. For instance, more than two supporting legs might be provided for each underbody support platform. Accordingly, it is desired that the scope of protection and monopoly granted by Letters Patent should not be limited by any details of the embodiment shown, or of the drawings, which were given for the purposes of explanation and illustration only, but solely by the appended claims.

What is claimed is:

1. A vehicle lift comprising:

(a) a pair of support pillars;

(b) a carriage which moves up and down relative to each of the support pillars;

(c) a supporting ramp, adapted to support a vehicle by its tires, said supporting ramp being coupled to each of the carriages; and (d) an underbody support coupled to each supporting ramp comprising an underbody contact member and a plurality of supporting legs pivoted to the underside of the underbody contact member which extend through holes in the support ramp in such a manner that when extended they project vertically downward and when folded they are substantially horizontal, said supporting legs being adapted to be held in the horizontal position by removable pins when folded, at least one of the support ramps being coupled to the respective carriage in a manner to be adjustably moved transversely so as to adapt its distance from the other support ramp to the width of various vehicles, whereby the supporting legs when unfolded support the underbody of the vehicle when the supporting ramps are lowered and the free ends of the supporting legs contact the ground, and continued lowering of the supporting ramps permits separation of the supporting ramps from the vehicle and thereby results in the vehicle being solely supported by the supporting legs.

2. A vehicle lift as in claim 1, wherein each underbody support comprises exactly two such supporting legs, and wherein when these legs are folded they are not lower than the lowermost parts of said support ramps.

3. A vehicle lift as in claim 1, wherein fixing means are provided for fixing the relative positions of the supporting legs each to the support ramp through which it projects, when its underbody support is raised with respect to said support ramp.

4. A vehicle lift as in claim 3, wherein said fixing means comprises pins which may be passed through holes in said supporting legs.

5. A vehicle lift as in claim 1, wherein the holes in said support ramps through which said supporting legs extend conform closely to the external shape of said supporting legs, so that when the underbody supports are raised with respect to said support ramps said supporting legs can only slide through said holes, and not pivot angularly with respect to said support ramps to a substantial degree.

* * * * *